US008206109B2

(12) United States Patent
Morgan

(10) Patent No.: US 8,206,109 B2
(45) Date of Patent: Jun. 26, 2012

(54) TURBINE BLADE ASSEMBLIES WITH THERMAL INSULATION

(75) Inventor: Victor Morgan, Greenville, SC (US)

(73) Assignee: General Electric Company, Schenectady, NY (US)

( * ) Notice: Subject to any disclaimer, the term of this patent is extended or adjusted under 35 U.S.C. 154(b) by 765 days.

(21) Appl. No.: 12/413,813

(22) Filed: Mar. 30, 2009

(65) Prior Publication Data

US 2010/0247329 A1 Sep. 30, 2010

(51) Int. Cl.
*F01D 5/20* (2006.01)
*F01D 5/08* (2006.01)

(52) U.S. Cl. ..... 416/97 R

(58) Field of Classification Search ..... 416/235, 416/231 B, 226, 229 A, 229 R
See application file for complete search history.

(56) References Cited

U.S. PATENT DOCUMENTS

| | | | |
|---|---|---|---|
| 4,359,310 A | 11/1982 | Endres et al. | |
| 5,820,337 A | 10/1998 | Jackson et al. | |
| 6,261,054 B1 | 7/2001 | Bunker et al. | |
| 6,454,526 B1 | 9/2002 | Cunha et al. | |
| 6,514,046 B1 | 2/2003 | Morrison et al. | |
| 7,080,971 B2 | 7/2006 | Wilson et al. | |
| 7,182,576 B2 | 2/2007 | Bunker et al. | |
| 2001/0025476 A1 | 10/2001 | Eldrid et al. | |
| 2001/0048878 A1 | 12/2001 | Willett et al. | |
| 2006/0056968 A1 | 3/2006 | Jacala et al. | |
| 2008/0260537 A1 | 10/2008 | Lang | |
| 2009/0169395 A1 * | 7/2009 | Wilson et al. | 416/97 R |

FOREIGN PATENT DOCUMENTS

GB 2172060 A 9/1986

OTHER PUBLICATIONS

European Search Report and Written Opinion for corresponding EP10157434, Aug. 5, 2010.

* cited by examiner

*Primary Examiner* — Ha Tran T Nguyen
*Assistant Examiner* — Valerie N Brown
(74) *Attorney, Agent, or Firm* — Nixon & Vanderhye P.C.

(57) ABSTRACT

A turbine blade assembly for a gas turbine includes a spar with raised ribs, a spacer with a plurality of protrusions mounted around the spar, and an outer shell mounted around the spacer. The protruding portions on the spacer surround the raised ribs on the spar. The protruding portions of the spacer act to space the interior surfaces of the outer shell away from the spar to provide a thermal insulation layer of cooling air.

21 Claims, 7 Drawing Sheets

TURBINE BLADE ASSEMBLIES WITH THERMAL INSULATION

BACKGROUND OF THE INVENTION

The invention is related to turbine blades (or buckets) used in gas turbine engines. In a typical gas turbine, fuel and air is mixed in a combustor and it is then ignited. The hot combustion gases are then directed over a plurality of turbine blades mounted on the exterior circumference of a rotating portion of the turbine. In a typical turbine, there will be multiple rows of turbine blades and associated nozzles. As the hot combustion gases from the combustor proceed through the turbine from the first set of turbine blades to the second, third and fourth sets of turbine blades, the gases begin to cool. However, the first and second sets of turbine blades are subjected to extremely high temperatures because they are the first to receive the hot combustion gas after it passes out of the combustors. The extremely high temperature gases can shorten the component life of the turbine blades.

BRIEF DESCRIPTION OF THE INVENTION

In one aspect, the invention may be embodied in a blade assembly for a turbine that includes a spar having a plurality of raised ribs which extend along exterior sides of the spar, a spacer mounted around the exterior sides of the spar and having a plurality of protruding portions that surround the raised ribs of the spar, and an outer shell mounted around the spacer.

In other aspects, the invention may be embodied in a method of assembling a blade assembly for a turbine that includes mounting a spacer having a plurality of protruding portions on a spar having a plurality of raised ribs which extend along exterior sides of the spar such that the protruding portions of the spacer surround the raised ribs, and mounting an outer shell around the spacer.

DETAILED DESCRIPTION OF PREFERRED EMBODIMENTS

Figure 1:
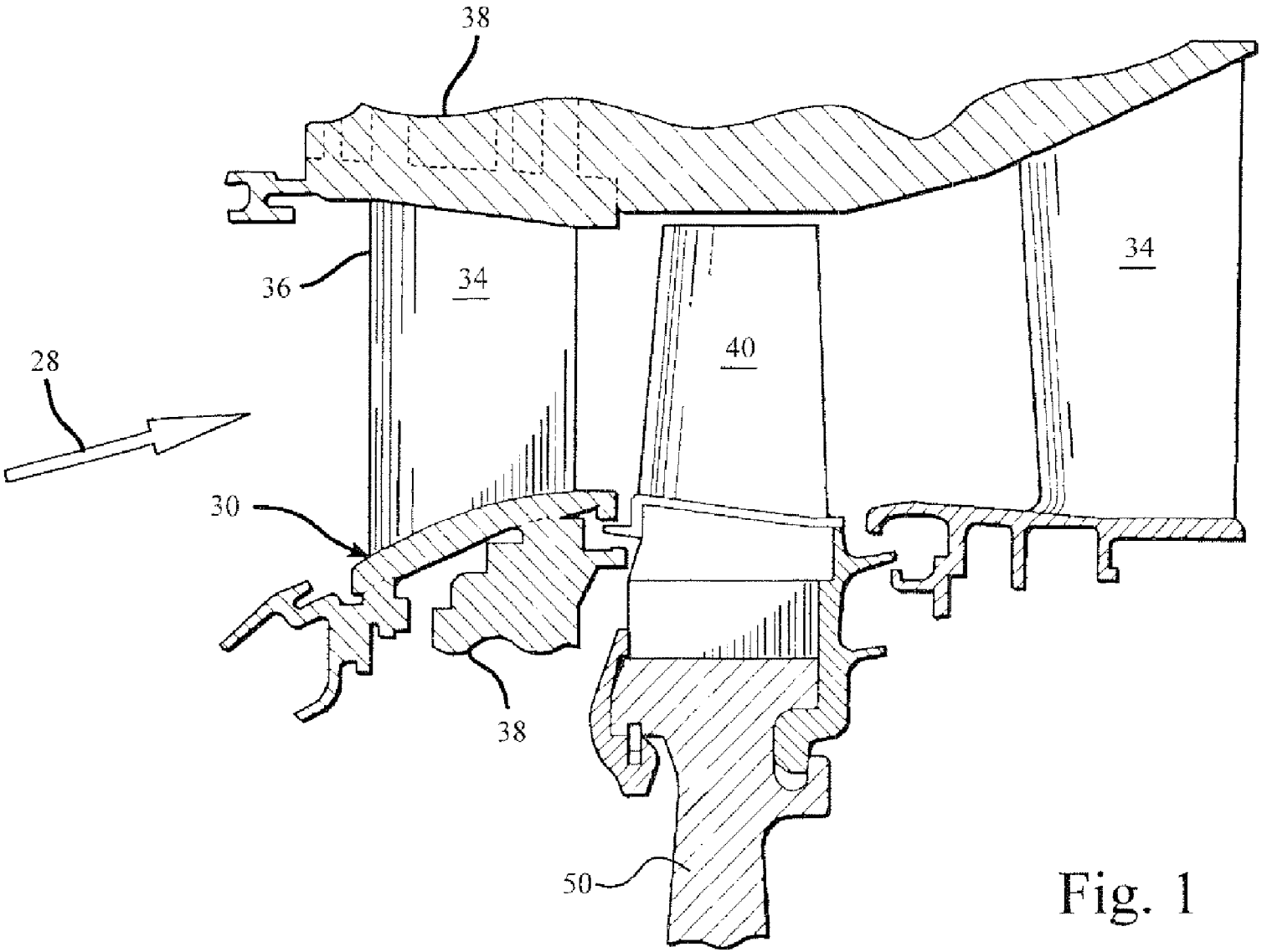
FIG. 1 is a cross-sectional diagram illustrating the first set of nozzles and turbine blades of a typical gas turbine.

The first set of nozzles and the first set of turbine blades of a typical gas turbine are illustrated in FIG. 1. Hot combustion gases would enter the assembly in the direction of arrow 28.

The hot combustion gases would first impinge upon a set of nozzle blades 34. The nozzle blades would direct the hot combustion gases in a specific direction as the combustion gases pass towards a first set of turbine blades or buckets 40. FIG. 1 also illustrates a nozzle blade 34 to the right of the turbine blade 40. This nozzle blade is part of a second set of nozzle blades that direct the combustion gases towards a second set of turbine blades. In a typical turbine, there would be additional sets of nozzles and blades positioned to the right of the turbine blade 40 shown in FIG. 1.

The turbine blade 40 is attached to a rotating member 50 which is itself attached to a rotating shaft of the turbine. The hot combustion gases which pass over the turbine blade 40 impart rotational motion to the attached rotating member 50 and shaft. As noted above, the first set of turbine blades to receive the hot combustion gases are subjected to extremely high temperatures which can cause wear and premature breakdown.

Figure 2:
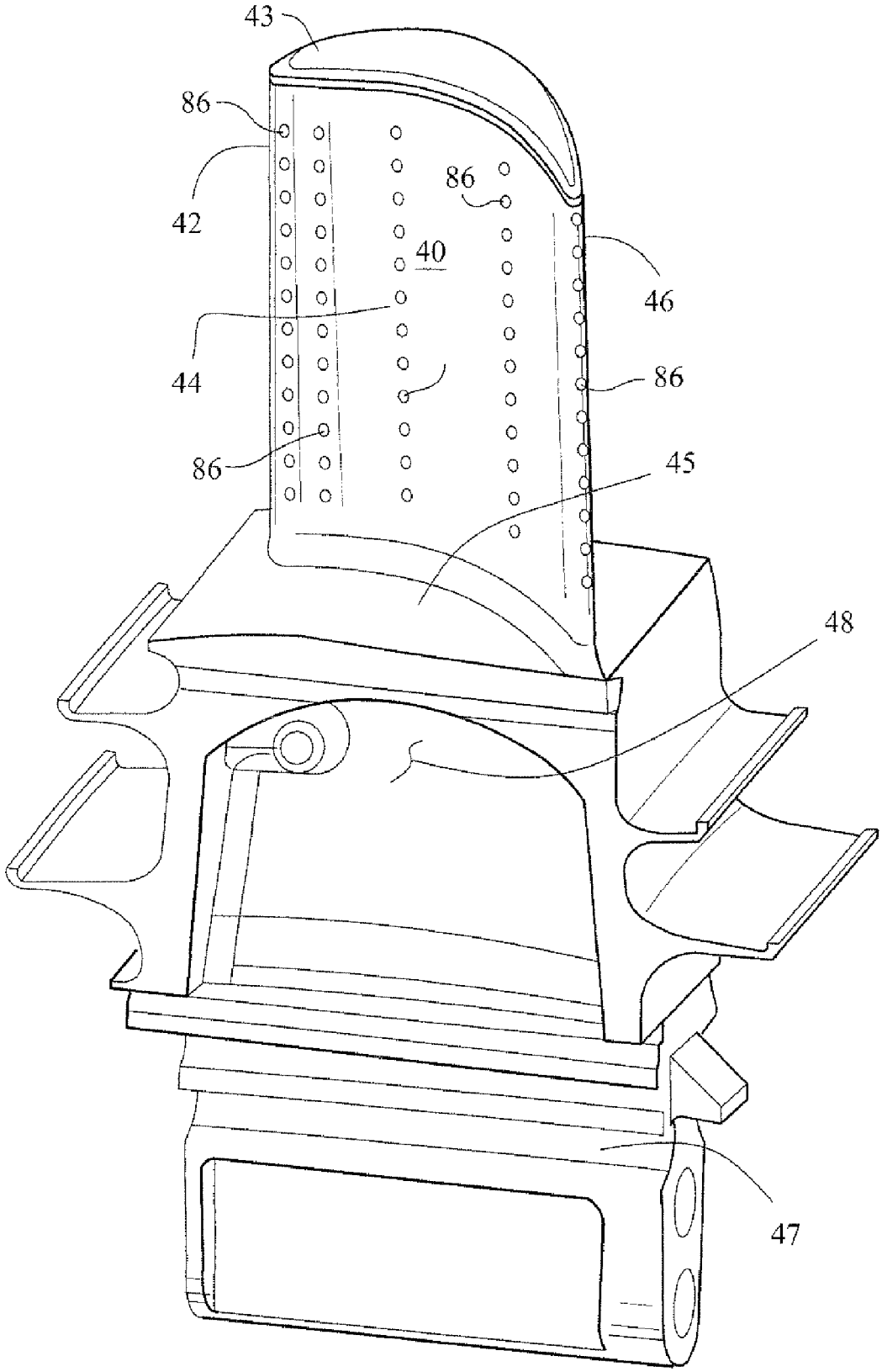
FIG. 2 is a perspective diagram of a turbine blade assembly.

FIG. 2 presents a more detailed view of the turbine blade assembly. The turbine blade 40 is attached to a base portion 47. The base portion 47 is configured to be attached to a rotating wheel of the turbine. The turbine blade assembly shown in FIG. 1 would be attached to the rotating member 50 shown in FIG. 1.

The turbine blade 40 includes a leading edge 42, side edges 44 and a trailing edge 46. The turbine blade 40 is either mounted on or protrudes through a base plate 45 attached to the base 47.

In some embodiments, to help cool the turbine blade, the turbine blade is provided with cooling air which enters an inner portion of the turbine blade 40 through the base 47. The cooling air washes over interior passages of the turbine blade 40 and then exits through a plurality of holes 86 located on the trailing edge 46.

Figure 3:
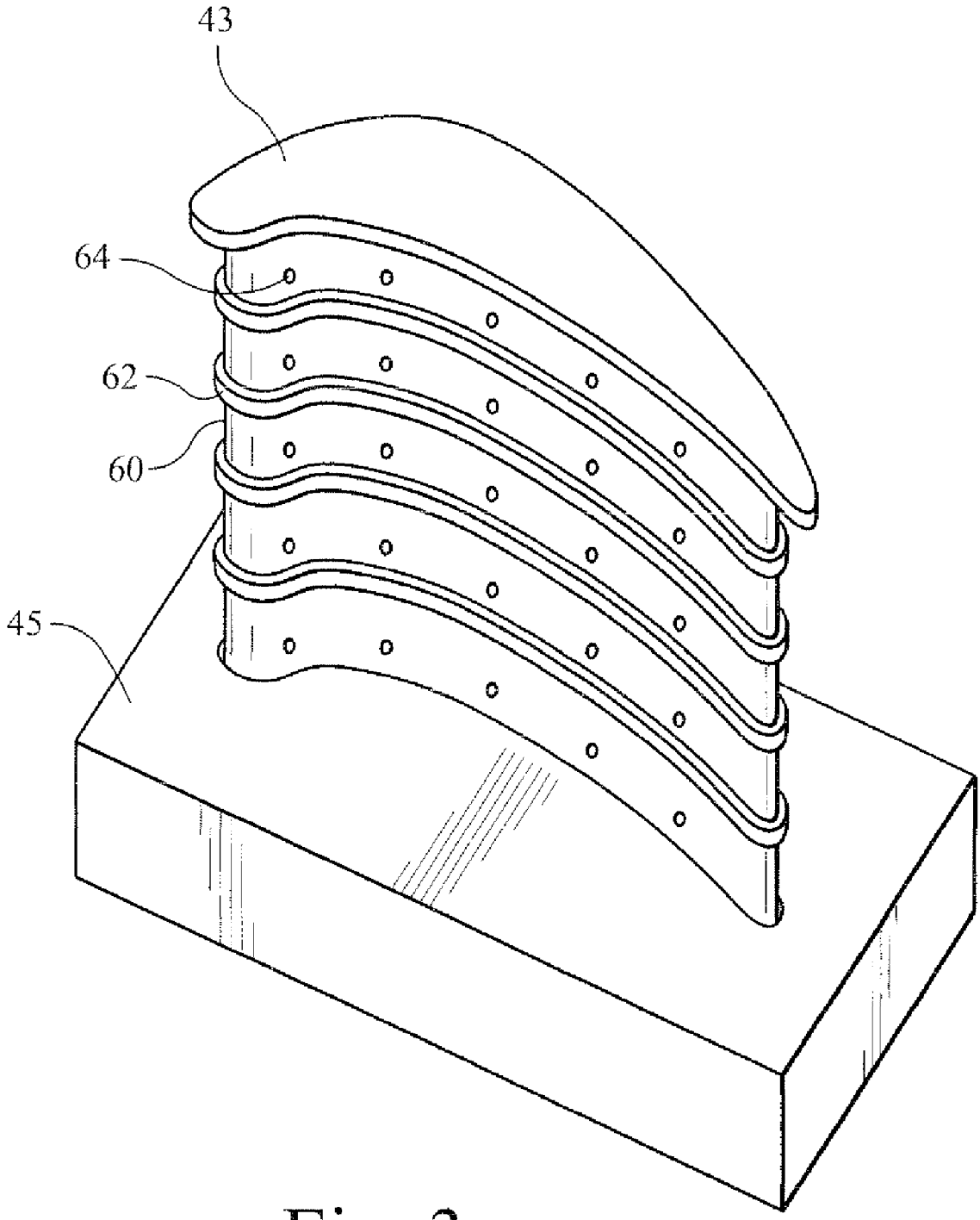
FIG. 3 is a perspective view illustrating the spar of a turbine blade assembly.
Figure 4:
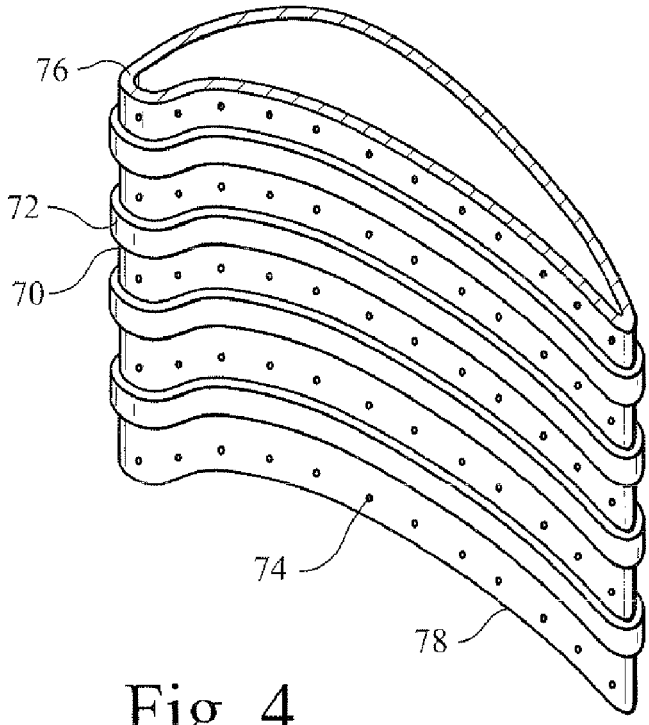
FIG. 4 is a perspective view illustrating a spacer of a turbine blade assembly.
Figure 5:
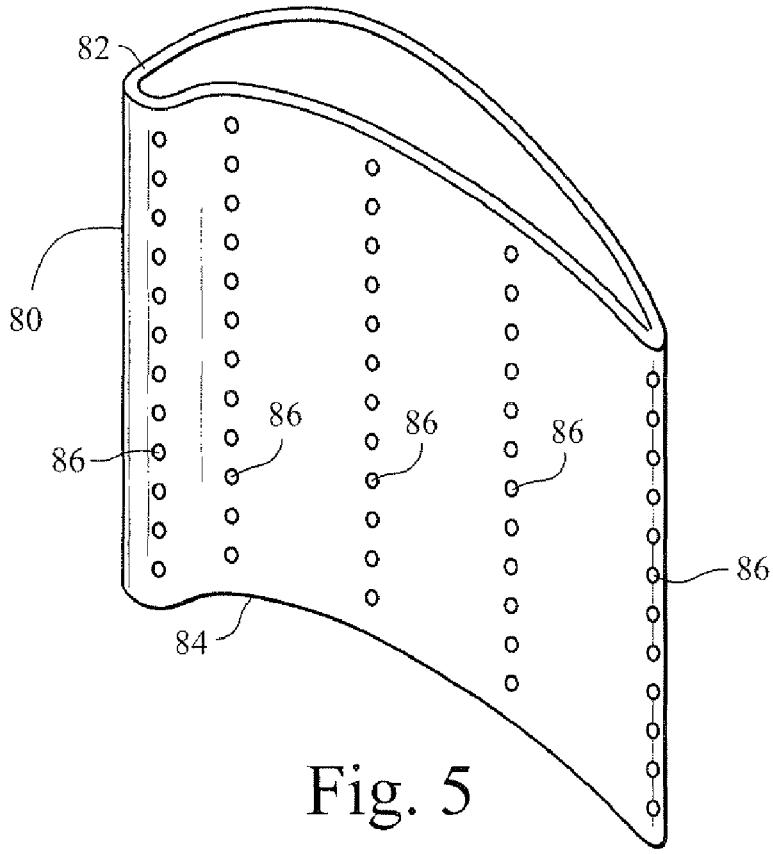
FIG. 5 is a perspective view illustrating an outer shell of a turbine blade assembly.

The actual blade portion 40 of the turbine blade assembly shown in FIG. 2 comprises multiple portions. Those multiple portions are illustrated in FIGS. 3-5. The turbine blade includes a ribbed spar, a spacer mounted around the spar, and an outer shell.

As shown in FIG. 3, the spar 60 of the turbine blade extends up through the base cover 45. A cap portion 43 is formed on or attached to a top of the spar 60. A plurality of raised ribs 62 extend around the exterior side surfaces of the spar 60. In addition, in some embodiments, cooling holes 64 are provided on the exterior side surfaces of the spar 60. The cooling holes are discussed in greater detail below.

The turbine blade assembly also includes a spacer 70, as illustrated in FIG. 4. The spacer 70 is a thin plate of metal having a shape generally similar to the exterior of the ribbed spar 60 shown in FIG. 3. The spacer includes a plurality of protruding portions 72 which extend out from the side surfaces of the spacer 70. In addition, a plurality of cooling holes 74 can also be formed through the spacer.

The protruding portions 72 on the spacer 70 have a shape and size which allows the protruding portions to surround the exterior of the ribs 62 on the spar 60. The width and height of the protruding portions 72 on the spacer are larger than the width and height of the raised ribs 62 on the spar 60. This feature will be discussed in greater detail below.

The turbine blade assembly further includes an outer shell 80 as illustrated in FIG. 5. The outer shell includes a top edge 82 and a bottom edge 84. In some embodiments, a plurality of apertures 86 may be formed at various locations on the outer shell. In some embodiments, the apertures may be formed only along the trailing edge of the outer shell 80. In alternate embodiments, a plurality of apertures could also be formed at other locations along the shell.

To assemble the turbine blade assembly, the spacer 70 would first be attached to the outer shell 80. The combination of the spacer and outer shell would then be mounted over the spar 60 such that the protruding portions 72 of the spacer 70 surround the raised ribs 62 of the spar 60. The upper edge 76 of the spacer and the outer shell 80 are located underneath the cap 43 on the spar 60.

Figure 6:
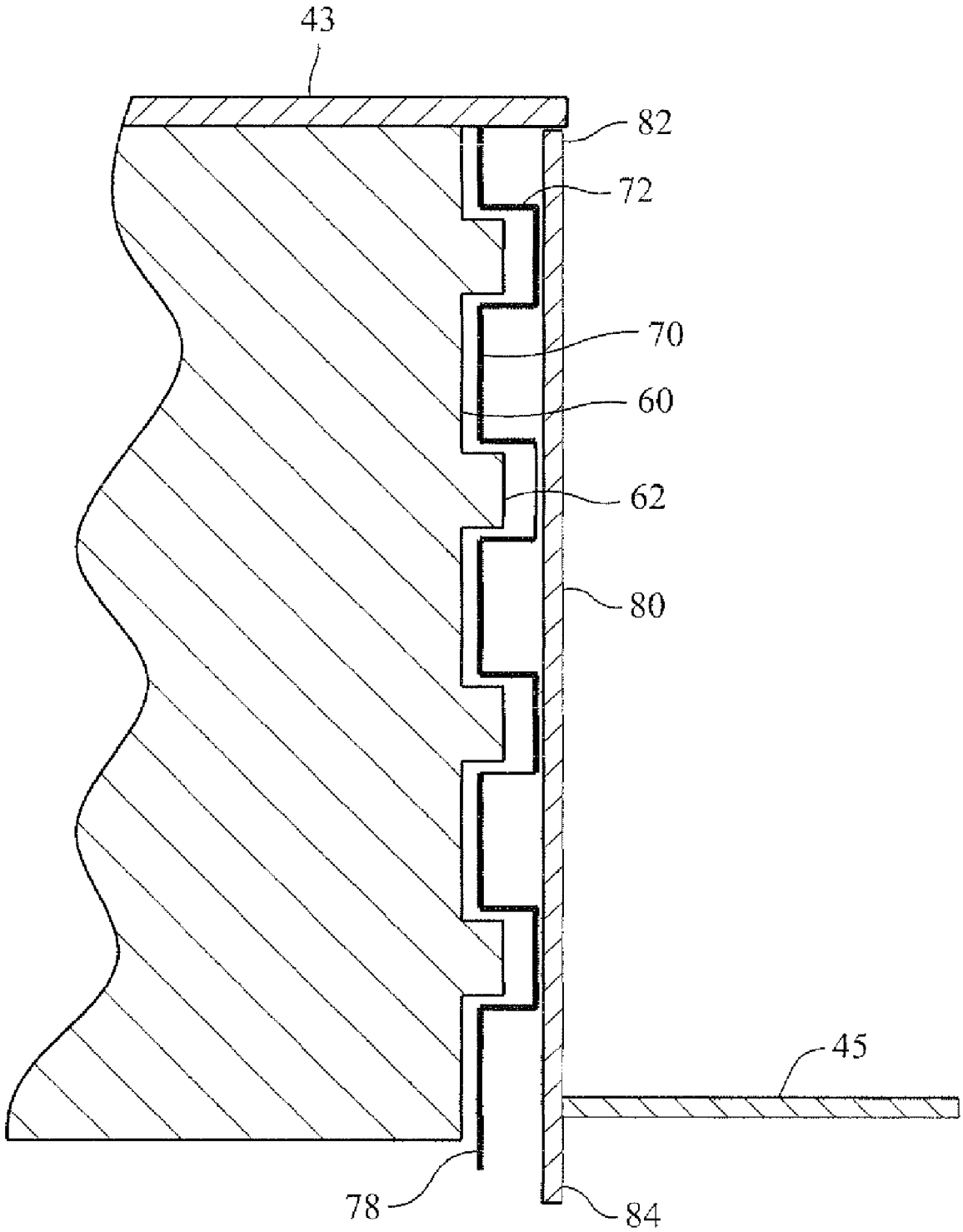
FIG. 6 is a cross-sectional view of a side surface of a turbine blade assembly.

FIG. 6 illustrates a cross-sectional view showing a side surface of the turbine blade assembly after it has been assembled. As shown therein, the thin spacer 72 is mounted around the exterior side surface of the spar 60. The protruding portions 72 of the spacer 70 extend around the raised ribs 62 on the spar 60. The top edge of the spacer abuts the underside of the cap 43. In addition, the outer shell 80 extends around the outer surfaces of both the spar 60 and the spacer 70. The upper edge 82 of the outer shell 80 also abuts the underside of the cap 43. In addition, the lower edge 84 of the outer shell 80 extends down through an opening in the base plate 45.

The spacer 70 ensures that the inner surfaces of the outer shell 80 are spaced away from the outer surfaces of the spar 60. As a result, cooling air can be circulated through this space between the outer surface of the spar and the inner surface of the shell 80. The width of the protruding portions 72 of the spacer 70, in other words, the distance they protrude out from the side of the spar, ensures that an air space is also maintained between the outer surfaces of the raised ribs 62 and the inner surfaces of the outer shell 80.

The spacer 70 serves to maintain the air gap between the shell and the spar. However, when the turbine blade rotates at extremely high rotational speeds, as is typical, the centripetal forces experienced by the spacer could cause deformation and/or displacement of the spacer. In addition, the force of the combustion gas impinging on the outer shell could also cause deformation of the spacer 70. The ribs 62 on the spar, which are inserted into the protrusions 72 on the spacer 70, help to prevent the spacer 70 and attached shell from becoming displaced or deformed due to either of these forces.

The air space maintained between the outer shell 80 and the spar 60 results in a significant temperature difference between the outer shell 80 and the spar 60. In other words, during operation, the spar of the turbine blade assembly will not be subjected to temperatures as high as those experienced by the outer shell 80. This makes it possible to form the spar from a less expensive material than would have been necessary if the spar material itself were directly exposed to the hot combustion gases. The lower temperatures experienced by the spar help to prolong the life of the turbine blade assembly and extend periodic maintenance intervals.

The fact that the spacer and the shell are allowed to move slightly with respect to the spar serves to reduce any stresses that might be generated by the heating and expansion of the individual parts.

In addition, forming a turbine blade as described above can lower the weight of the blade assembly. In other words, when a blade as described above has the same exterior dimensions as a solid blade, the blade as described above will be lighter due to the air spaces. This reduction in weight can be beneficial in many different ways. First, it reduces the centrifugal loading on the rotating parts that hold and support the turbine blades. In addition, it reduces the overall rotating mass of the turbine assembly.

Moreover, when a turbine blade is constructed as described above, and the exterior surface of the turbine blade begins to experience significant wear, it is possible to replace just the exterior shell. The underlying parts of the turbine blade need not be replaced, just the shell. This serves to reduce the cost of maintaining a turbine.

In some embodiments, cooling air is deliberately circulated from an interior of the spar, through the spacer, and then out through the outer shell. This flow of cooling air helps to keep the turbine blade assembly as a sufficiently low temperature. In addition to keeping the spar at a low temperature, circulating cooling air in this fashion would also help to cool the spacer and the shell.

Figure 7:
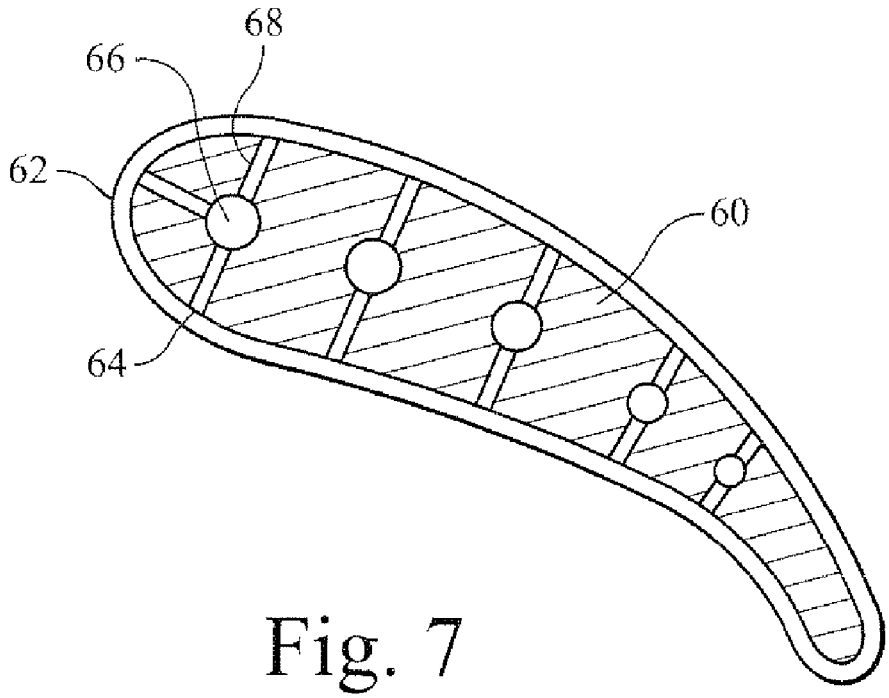
FIG. 7 is a top cross-sectional view of the spar of a turbine blade assembly.

FIG. 7 illustrates a cross-sectional top view of a spar of one embodiment of a turbine blade assembly. As shown therein, a plurality of main cooling air passages 66 extend up the height of the spar. Additional cooling air passages 68 extend from the main cooling air passages 66 out to exterior side surfaces of the spar 60. The exit of the cooling air passages 68 form the cooling air holes 64 on the sides of the spar, as illustrated in FIG. 3.

The air circulating through the spar and exiting the spar would serve to cool the spar itself. In addition, the cooling air exiting the spar is allowed to pass through the apertures 74 formed in the spacer 70. The cooling air passing through the apertures 74 in the spacer would then flow over inner surfaces of the outer shell 80 to help cool the outer shell 80. The cooling air can then exit the outer shell 80 through the apertures 86 in the outer shell. As noted above, the apertures 86 in the outer shell 80 could be provided at multiple different locations on the shell 80.

In some embodiments, cooling air may be directed from the base of the turbine blade assembly up into the space formed between the outer shell and the spar. This can be the only form of cool air supply, or cool air can be directed up from the base into the space between the spar and shell, and also be provided through cooling air passages in the spar itself, as explained above.

Figure 8:
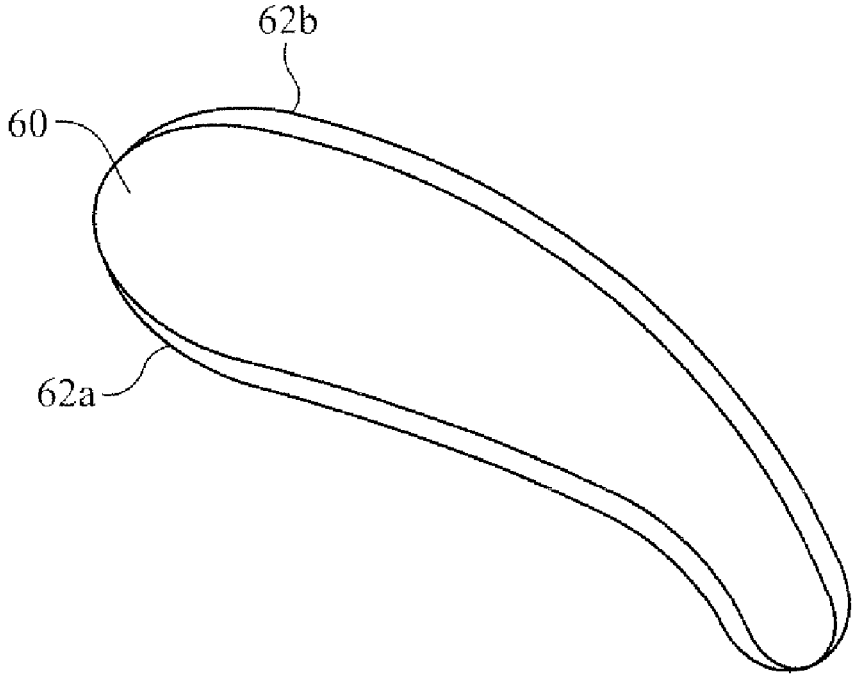
FIG. 8 is a top view of a spar of an alternate embodiment of a turbine blade assembly.

In the embodiment illustrated in FIG. 3, the raised ribs 62 extend all the way around the side surfaces of the spar 60. In an alternate embodiment illustrated in FIG. 8, the raised ribs may extend only down side surfaces of the spar. As shown in FIG. 8, a first raised rib 62*a* passes down a first side of the spar 60, while a second raised rib 62*b* passes down the second side of the spar 60. In an embodiment as illustrated in FIG. 8, the spacer and the outer shell 80 might directly abut the spar at the leading edge and/or at the trailing edge.

The spacer and the outer shell could be attached to the spar in many different ways. In some embodiments, the spacer and the outer shell may be provided in two or more different sections which are attached together around the exterior of the spar.

Figure 9:
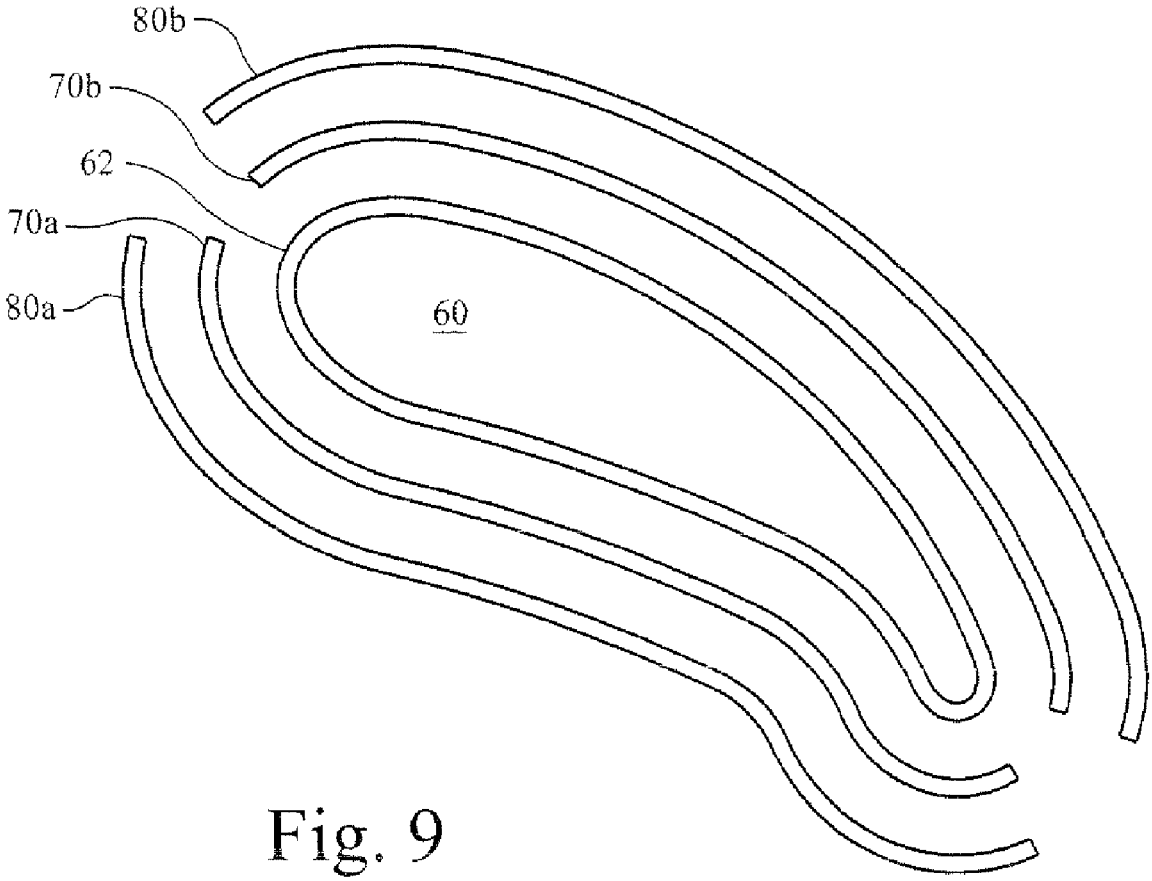
FIG. 9 is a top exploded view illustrating a spar, a spacer and an outer shell of a turbine blade assembly.

As shown in FIG. 9, the spacer may include a first half 70*a* and a second half 70*b* which are brought together around the exterior of the spar 60. In addition, the outer shell may be formed of two different sections 80*a* and 80*b* which are brought together around the exterior of the spacer 70. The ends of the exterior shell and/or the spacer could be attached together in any suitable fashion.

Figure 10:
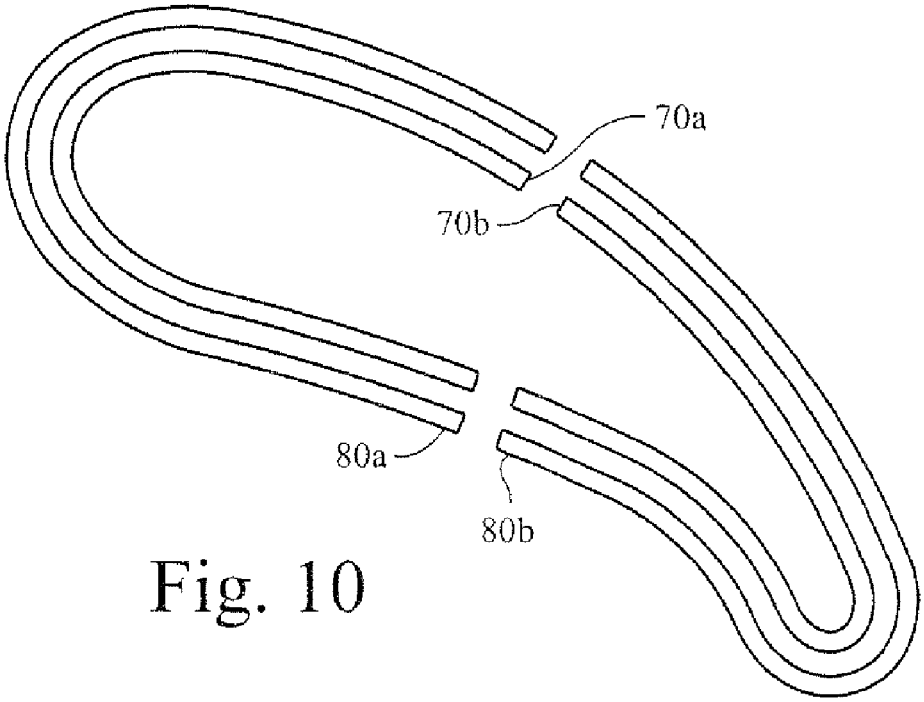
FIG. 10 is a top view illustrating a spacer and an outer shell of a turbine blade assembly.

FIG. 10 illustrates another embodiment where the ends of the two portions forming the spacer and the outer shell come together along side edges of the blade assembly.

In other embodiments, the spacer and the outer shell could be formed of more than two sections, and the ends of the sections could be joined together at any place along the exterior of the blade assembly. In still other embodiments, the spacer could be formed from a plurality of strips, each of which is installed over one of the ribs on the spar.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A blade assembly for a turbine, comprising:

a spar having a plurality of raised ribs which extend along exterior sides of the spar;

a spacer mounted around the exterior sides of the spar and having a plurality of protruding portions that surround the raised ribs of the spar; and an outer shell mounted around the spacer.

2. The blade assembly of claim 1, further comprising a cap mounted on a top of the spar.

3. The blade assembly of claim 2, wherein an upper edge of the outer shell abuts an underside of the cap.

4. The blade assembly of claim 1, further comprising a base that is configured to be coupled to a rotating shaft of a turbine, wherein the spar is mounted to the base.

5. The blade assembly of claim 4, wherein the base comprises a base cover having an aperture through which the spar extends, and wherein a lower edge of the outer shell is mounted in and extends through the aperture of the base cover.

6. The blade assembly of claim 1, wherein a width of the protruding portions of the spacer is larger than a width of the raised ribs of the spar.

7. The blade assembly of claim 1, wherein the spacer ensures that an inner surface of the outer shell is spaced from an outer surface of the spar.

8. The blade assembly of claim 7, wherein the spacer ensures that an inner surface of the outer shell is spaced from outer ends of the raised ribs of the spar.

9. The blade assembly of claim 1, wherein the spar comprises:

at least one cooling air passage that extends along a height of the spar; and at least one effusion cooling passage that extends from the at least one cooling air passage to an effusion cooling hole formed on an exterior side of the spar.

10. The blade assembly of claim 9, wherein a plurality of spacer apertures are formed through the spacer such that cooling air escaping the at least one effusion cooling passage of the spar can pass through the spacer apertures of the spacer to impinge on an inner surface of the outer shell.

11. The blade assembly of claim 10, wherein a plurality of shell apertures are formed through the outer shell, and wherein cooling air delivered to an inner surface of the outer shell can pass through the shell apertures to escape from the blade assembly.

12. The blade assembly of claim 11, wherein the shell apertures are formed along a trailing edge of the outer shell.

13. The blade assembly of claim 1, wherein the raised ribs of the spar extend only along side surfaces of the spar.

14. The blade assembly of claim 1, wherein the spacer comprises multiple sections that are attached together when the spacer is mounted on the spar.

15. The blade assembly of claim 14, wherein the outer shell comprises multiple portions that are attached together when the outer shell is mounted around the spacer.

16. The blade assembly of claim 1, wherein the outer shell comprises multiple portions that are attached together when the outer shell is mounted around the spacer.

17. The blade assembly of claim 16, wherein end edges of the multiple portions of the outer shell are attached together at sides of the blade assembly.

18. A method of assembling a blade assembly for a turbine, comprising:

mounting a spacer having a plurality of protruding portions on a spar having a plurality of raised ribs which extend along exterior sides of the spar such that the protruding portions of the spacer surround the raised ribs; and mounting an outer shell around the spacer.

19. The method of claim 18, wherein the step of mounting a spacer on the spar comprises bringing two sections of the spacer together from opposite side of the spar and attaching the two sections together.

20. The method of claim 18, wherein the step of mounting an outer shell around the spacer comprises bringing two sections of the outer shell together from opposite sides of the spar and attaching the two sections together.

21. The blade assembly of claim 2, further comprising a base with a base cover having an aperture through which the spar extends, and wherein the spacer extends along substantially an entire height of the spar extending from the base cover to the cap.

* * * * *